United States Patent [19]

Davitian

[11] Patent Number: 5,067,615

[45] Date of Patent: Nov. 26, 1991

[54] RECLOSABLE BOX AND BLANK THEREFOR

[76] Inventor: Edward Davitian, 420 E. 55th St., New York, N.Y. 10021

[21] Appl. No.: 522,270

[22] Filed: May 11, 1990

[51] Int. Cl.[5] ..... B65D 5/54

[52] U.S. Cl. ..... 229/230; 229/125; 229/160.1; 229/231

[58] Field of Search ..... 206/621.3, 621.6, 624, 206/628; 229/160.1, 125

[56] References Cited

U.S. PATENT DOCUMENTS

| | | | |
|---|---|---|---|
| 2,315,947 | 4/1943 | Edmonson | 229/160.1 |
| 2,396,310 | 3/1946 | Yungblut | 206/624 |
| 2,848,153 | 8/1958 | Geiger, Sr. | 206/624 |
| 2,881,967 | 4/1959 | Ringler | 206/624 |
| 3,078,029 | 2/1963 | Lacey | 229/160.1 |
| 3,306,514 | 2/1967 | MacKendrick | 206/621.3 |
| 3,347,446 | 10/1967 | Guyer et al. | 229/160.1 |
| 3,640,447 | 2/1972 | Forbes, Jr. et al. | 220/418 |
| 4,294,399 | 10/1981 | Wilfer | 229/160.1 |
| 4,909,395 | 3/1990 | Weissman | 206/621.6 |

*Primary Examiner*—Gary E. Elkins
*Attorney, Agent, or Firm*—Darby & Darby

[57] ABSTRACT

A reclosable box constructed from a flat blank which is cut and folded is featured by a number of different locking devices which may be used alone or in combination. The box can be constructed from a single flat blank and is easily mass produced, and is suited for automated assembly and filling operations. The reclosable portion of the box does not interfere with filling of the box in production. In addition to providing locking devices to keep the box closed until intentionally reopened, devices are disclosed which hold the reclosable portion of the box in an open position to dispense contents of the box. The mouth of the box can be configured to allow redimensioning of the mouth by the user so that selected contents can be dispensed in chosen measured portions.

20 Claims, 11 Drawing Sheets

RECLOSABLE BOX AND BLANK THEREFOR

FIELD OF THE INVENTION

The present invention relates to a box constructed from a flat blank which is cut and folded. More particularly, the invention relates to a box with a hinged portion for opening and reclosing the box, and to a flat blank used to construct such a box.

BACKGROUND OF THE INVENTION

There are numerous known boxes with hinged portions for opening and reclosing. These boxes can be described generally as having four sides and two ends, the reclosable portion usually provided at one of the ends of the box.

One of the simplest types of reclosable boxes is the box with a perforated end flap like the one disclosed in U.S. Pat. No. 4,142,635 to Capo et al. Such flaps are usually provided with an edge tab of some kind which is insertable in a slot to thereby reclose the box after the perforated flap is torn open.

Some other known boxes are more elaborate, having relatively large hinged covers with skirts or depending flanges which cover the box on its sides, unlike a simple flap. Examples of these types of boxes can be found in U.S. Pat. No. 4,048,052 to Tolaas; U.S. Pat. No. 4,421,236 to Lowe; and U.S. Pat. No. 4,570,790 to Turnage.

Still another type of reclosable box is shown in U.S. Pat. No. 4,733,796 to Halverstadt et al. This last type is similar to the large hinged covers with skirts, but here the skirts of the cover actually form a portion of the sides of the box.

Each type of box has its advantages and disadvantages, usually low cost of manufacture or security of the closure, one of these being sacrificed to provide the other. However, aside from these considerations, some types of boxes are better suited for particular products. For example, the simple end flap is widely used in boxes containing pourable material, whereas the larger hinged covers are more typically used in boxes containing larger solid contents such as cigarettes, or contents which are not pourable such as ice cream.

An important feature of all of the boxes mentioned above is a locking means of some type, that is some means to keep the hinged closable portion of the box securely closed until it is intentionally reopened. As previously mentioned, in the case of the simple flap, the locking means is usually an end tab insertable into a slot. In the case of the larger hinged covers, known locking means include a slit or cut line in the front skirt of the cover which engages with a locking flange in the form of a tab extending from a side of the box as shown in U.S. Pat. No. 4,048,052. Often the locking means is simply the surface contact (or nesting) of the skirt portion of the cover with the sides of the box as shown in U.S. Pat. Nos. 4,570,790 and 4,421,236. Still another locking means is shown in U.S. Pat. No. 4,733,796 where a pair of lips and grooves in the cover portion engage a similar pair of lips and grooves in a side portion of the box.

Each of these locking means has advantages and disadvantages often associated with the competing interests of security of locking and reduced cost of manufacture. Moreover, some locking means can be adapted only to particular box designs.

In some cases, the locking means have the disadvantage of being difficult to use. For example, the flap type opening with the slot insertable tab requires the user to deliberately insert the tab into the slot in order to provide any locking at all.

Of all of the known boxes discussed above, two have a particular advantage that the others do not have. The reclosable openings shown in U.S. Pat. Nos. 4,421,236 and 4,142,635 can both be described as pouring spouts. Although not disclosed in these patents, such a pouring spout opening can be used to dispense a measured portion of contents such as pasta. For example, spaghetti type pasta aligned in a box, perpendicular to the opening, will empty from the box in an amount directly proportional to the size of the opening. If the box is tilted to stop pouring before the pasta is completely free from the box, a measured portion can be obtained and removed manually. Unfortunately, of all the boxes discussed above, those with the pouring spout type opening provide the least secure locking means.

INCORPORATION BY REFERENCE

The complete disclosure of each of the U.S. Patents discussed above, namely U.S. Pat. Nos. 4,048,052; 4,142,635; 4,421,236; 4,570,790; and 4,733,796, is incorporated herein by reference.

SUMMARY OF THE INVENTION

It is an object of this invention to provide a reclosable box which can be inexpensively produced from a flat blank by cutting and folding and where the reclosable portion of the box is provided with secure locking means.

It is also an object of this invention to provide a reclosable box where the locking means is easy to use and does not require deliberate difficult manipulation of the box by the user.

Yet another object of this invention is to provide a reclosable box where a plurality of locking means may be employed, either individually or in combination.

Still another object of this invention is to provide a reclosable box where the reclosable opening is configured such that measured portions of selected contents may be easily dispensed. Moreover, it is an object of the invention to provide means whereby the user can reconfigure the box opening to dispense single or double measured portions.

It is also an object of this invention to provide a reclosable box where the reclosable portion is provided with means to keep the box open as well as means to lock it shut.

Another object of this invention is to provide a flat blank in one piece, hinged in such a manner so as to provide accuracy in positioning of a flap when folded over onto the main body of the blank.

It is still another object of the invention to provide a blank, which after folding and gluing on one side, produces a box that has openings on its top and bottom, that can be used by box manufacturers and box users with little or no modification to existing machinery.

All of these objects are achieved by the box according to this invention which can be constructed from a single flat blank which is scored, perforated and die cut prior to folding. The blank comprises four side panels and two ends, the ends each comprising four flaps, one flap at each end of each side panel. Side panels and flaps are defined by fold lines.

In accordance with this invention, a reclosable opening is created at one end of the box by perforations, cuts or fold lines on three adjacent flaps and the side panels adjacent to these flaps. For example, in one embodiment, a central side panel is provided with an orthogonal fold line which joins angled perforated lines on each of the two panels adjacent to it, thus forming a substantially trapezoidal shape below the fold lines separating panels from flaps. The perforated lines on the adjacent side panels connect with cut or perforated lines on respective adjacent flaps. Thus, when the flaps and panels are folded on their fold lines and the box is constructed, a perforated hinged corner is created. In various embodiments of the invention, additional specified folds, cuts and perforations in the flaps and side panels provide a variety of locking means when the box is constructed from the blank.

In a preferred embodiment of the invention, an additional section of essentially trapezoidal shape is provided with cut and fold lines and glued to the three adjacent side panels in the vicinity of the above-mentioned orthogonal fold line. This additional section can be constructed from the same single blank by cutting and folding an extended portion of the above-mentioned flaps or can be a separate piece from a second blank. When the box is constructed, this additional section provides side panel coverage in the corner of the box when the cover is hinged open. Moreover, this additional section can be cut with shoulders or recesses in such a way that it interacts with mating shoulders or recesses cut in the hinged portion described above.

In yet another embodiment of the invention, perforations are provided on flaps to allow redimensioning of the box opening (mouth) by the user.

The box constructed according to this invention closes easily and stays closed until intentionally reopened because up to four different locking means can be employed. The mouth of the box can be redimensioned by the user to dispense measured portions of selected contents such as spaghetti. The box can be advantageously used to contain and dispense almost any dry product, e.g., pet food, bird seed, cereal, bread crumbs, prunes, raisins, small cookies, potato buds, noodles or any other pasta, rice, powdered detergent, powdered bleach, etc.

The blank for constructing the box can be made of any cardboard, laminated, waxed, foiled, coated, plain, thin or thick and also can be made of plastic material.

BRIEF DESCRIPTION OF THE DRAWINGS

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
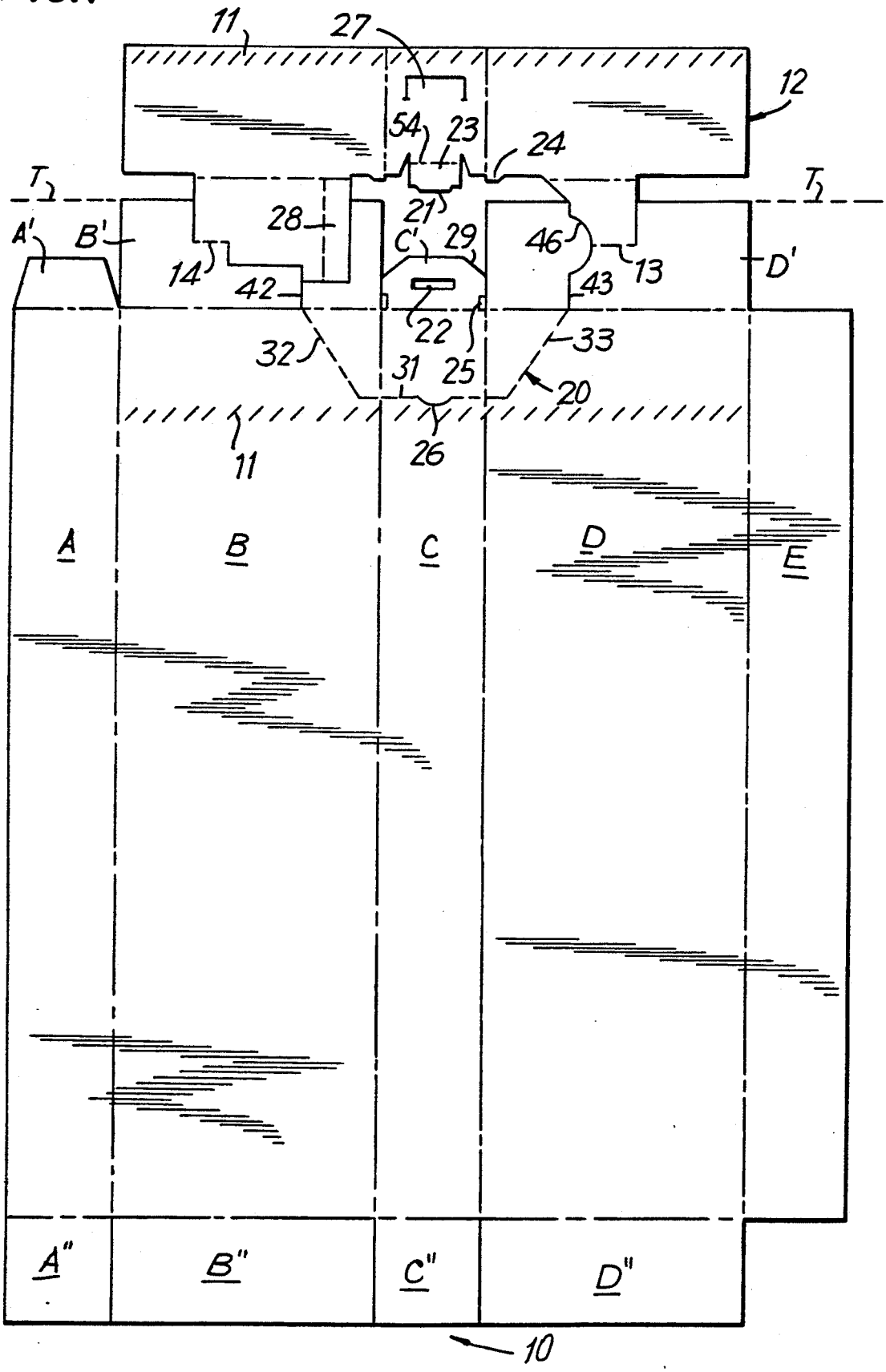
FIG. 1 is a plan view of a flat blank used to construct a box according to a preferred embodiment of the invention.

Referring now to FIG. 1, one embodiment of a blank 10 of the invention is shown. This blank may be constructed of various paperboard materials, including boxboard or any other semi-rigid packaging material. It is advantageous but not necessary that the blank be a single integral blank so that it can be cut from a continuous web of material, or stamped from a single sheet of suitable material. The blank 10 shown in FIG. 1 is designed to be erected into a generally rectangular box of the invention and is depicted in FIG. 1 showing what will become substantially the inside of the box of the presently described preferred embodiment invention.

It will be readily understood by those of ordinary skill in the art that the blank 10 is suitable for and intended to be cut or stamped from a continuous web or sheet, folded and glued, and subsequently filled and finally closed by high speed, automatic machines and automated processes designed for such purposes, as is customary. A box constructed from the blank 10 which is manually assembled, filled and closed is nonetheless considered well within the scope of the invention.

The preferred embodiment of blank 10 shown in FIG. 1 may be conveniently divided by fold lines into four side panels A,B,C,D, plus an extended portion E for gluing to side panel A, and eight flaps A′,B′,C′,D′ and A″,B″,C″,D″. The number and size of the flaps may be adjusted as will be discussed below and as would be known to one skilled in the art. When the box is folded, side panel A and extended portion E overlie each other to any suitable degree and are glued together. As illustrated in FIG. 1, the side panel A and extended portion E are coextensive in area.

The reclosable opening 20 of the box is constructed from a plurality of cuts and folds shown at the top of the blank in the vicinity of where the side panels B,C,D adjoin their adjacent flaps B′,C′,D′. It should be clear, however, that the reclosable opening 20 could be positioned at the bottom of the blank or on either side of the blank by appropriate scaling of dimensions, and such repositioning would involve no more than ordinary skill in the art.

It is helpful to refer also to FIGS. 3–8 while examining FIG. 1 to get a better idea how each cut and fold in FIG. 1 operates in the box after it is constructed from the blank.

In the preferred embodiment of FIG. 1, the hinged portion of the reclosable opening 20 is provided by fold line 31 in panel C. Fold line 31 may optionally be provided with a central rounded cut (or perforation) 26, the function of which is described below. Perforated or cut lines 32,33 in the adjacent side panels B,D adjoin fold line 31 and connect with the cut lines 42,43 respectively in the flaps B',D'. As shown in FIG. 1, the cut lines 42,43 are short to accommodate additional section 12 which is constructed partially from flaps B',D' and partially from portions extending therefrom. This additional section 12, however, could easily be constructed as an entirely separate piece, in which case the cut lines 42,43 would extend to the end of the flaps B',D', and the flaps would not be extended as shown, but would end at a point shown approximately by the dashed line T.

Figure 3:
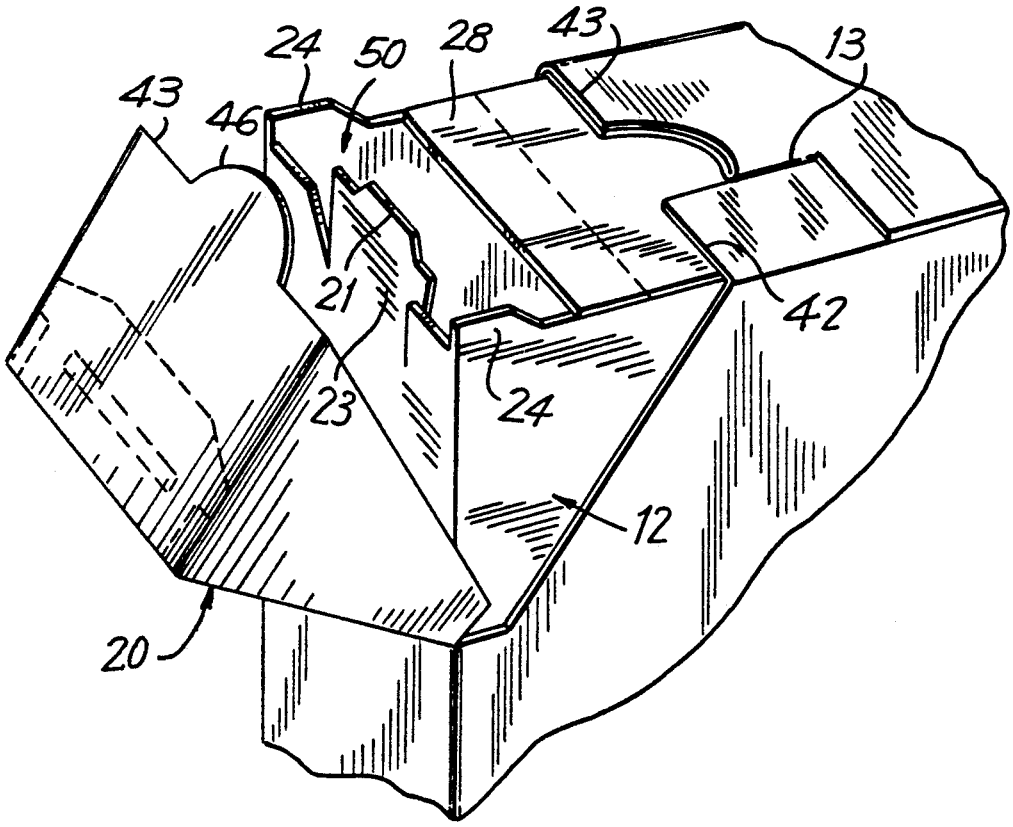
FIG. 3 is a perspective view of one corner of a box constructed according to FIG. 1 and shown in an opened position.
Figure 4:
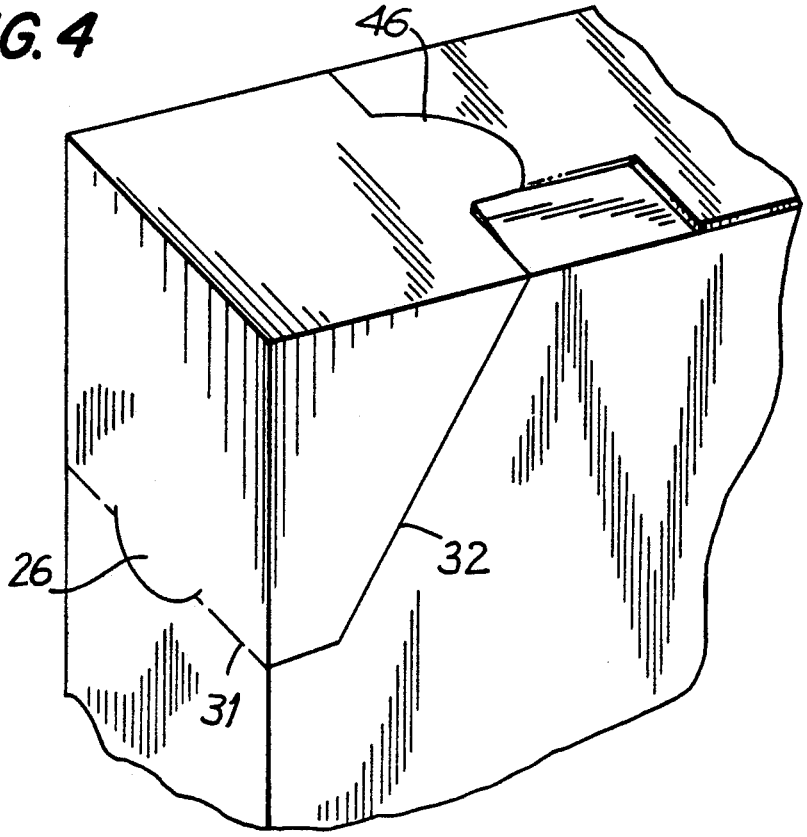
FIG. 4 is a view similar to FIG. 3, but shown in the closed position.

Either of the cut lines 42,43 may be provided with a rounded portion 46 which functions as an insertable tab locking means when the box is constructed. The rounded portion 46 also serves as a lifting tab for ease of opening the box. As shown in FIG. 1, cut line 43 is provided with such a rounded portion 46. Referring to FIGS. 3 and 4, one can readily see how cut line 42 then interacts with the rounded portion 46 of cut line 43 to act as a tab locking means when the box is constructed.

Figure 1A:
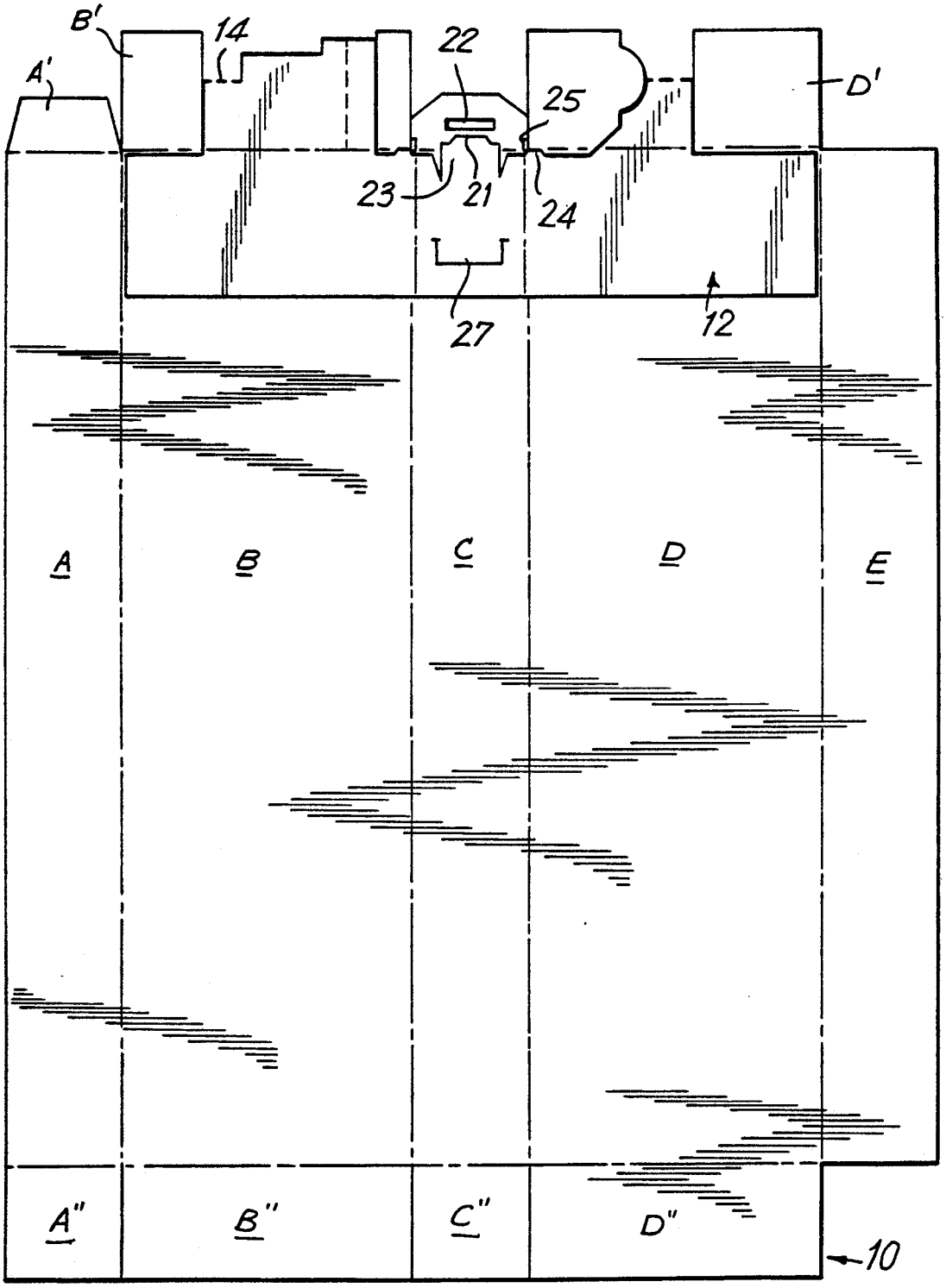
FIG. 1A is a view similar to FIG. 1, but with additional section 12 folded down.

In the preferred embodiment, additional section 12 is constructed from the extended flaps B',D' so that it can be folded at fold lines 13,14 to assume its useful position as shown in FIG. 1A. In this illustrated position, additional section 12 is affixed to the side panels B,C,D, preferably by applying an adhesive material or glue along the cross-hatched area 11 as shown in FIG. 1. In practice, the manner and location of gluing will be determined by the particular gluing apparatus and processes employed, as is conventional. This preferred embodiment conserves materials and allows for more accurate registration of the additional section 12.

This additional section 12 is shown in the figures as substantially rectangular in shape. The purpose of the additional section 12 is essentially twofold, to provide a replacement portion for the side panels B,C,D beyond the hinge line 31 and the cut or perforated lines 32,33 after the box has been opened, so that the mouth 50 of the box is confined to the top of the box, as seen in, for example, FIGS. 3, 5, and 8, and also to provide additional locking and spring means for the reclosable opening 20. In some embodiments, all of these features may not be desired and additional section 12 can be reconfigured accordingly, as seen in, for example, FIGS. 9 and 10.

The rectangular shape of additional section 12 provides at least two additional benefits according to the invention. First, additional rigidity is provided to the side panels B,C,D so that heavier or denser products may be suitably packaged in the box for a given sheet thickness or "gauge." Second, because the glue area 11 may extend substantially across the entire widths of the side panels B,C,D, fine-grained material such as detergent may be prevented from leaking out through any separation which might otherwise exist between the side panels and the folded-down additional section 12. However, other shapes such as trapezoidal, would also be suitable, if the aforementioned additional benefits are not desired.

Figure 5:
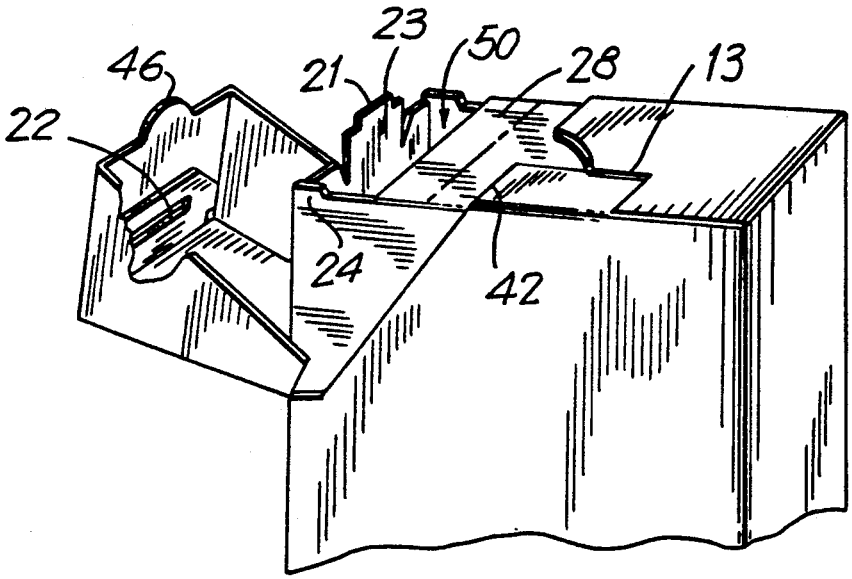
FIG. 5 is a view similar to FIG. 3, but from a different angle.
Figure 7:
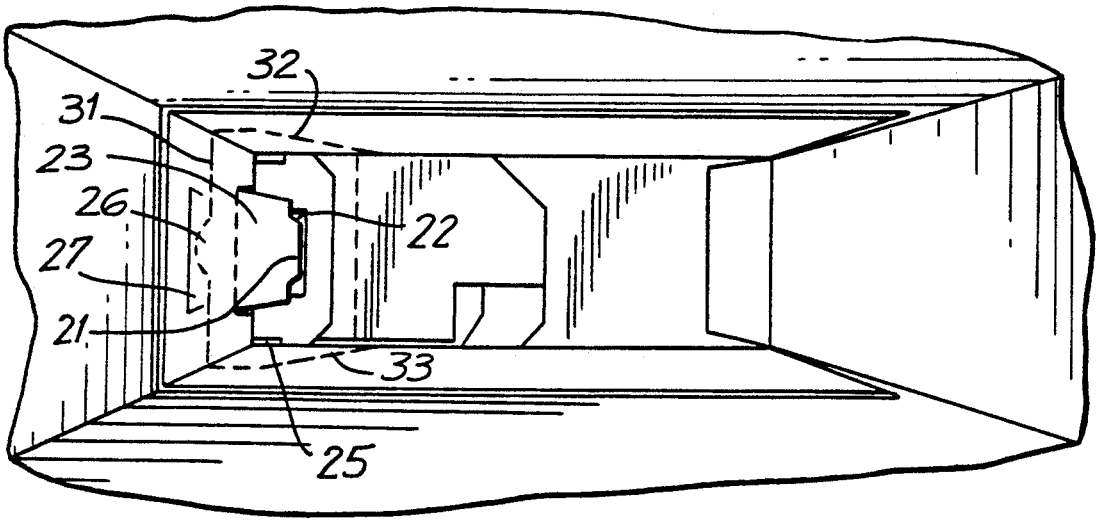
FIG. 7 is a perspective view from inside a closed box constructed according to FIG. 1.
Figure 8:
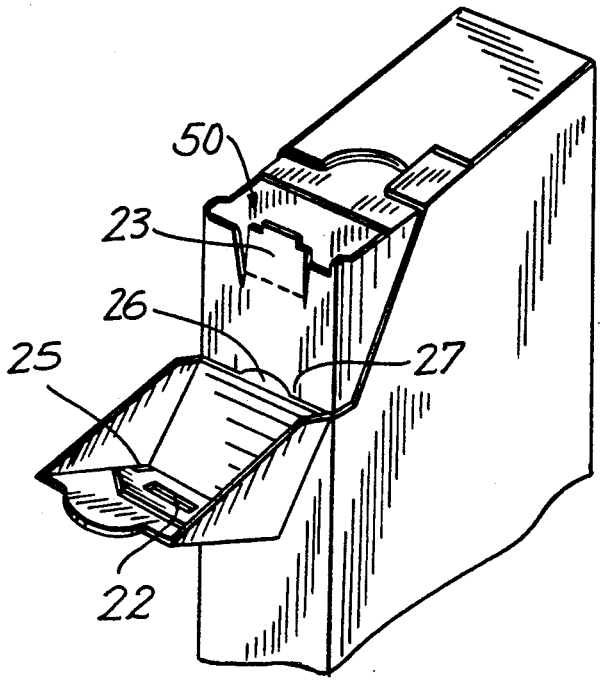
FIG. 8 is a view similar to FIG. 3 but with a larger mouth.

According to a preferred embodiment, additional section 12 provides two types of interactive locking means with a specific configuration of flap C' as shown in FIG. 1. According to the embodiment of FIG. 1, a lower portion of flap C' is cut with three openings, a slot-like opening 22 and two smaller edge (notch-like) openings 25. This portion of flap C' is folded so that it lies on the inside top surface of reclosable opening 20, as seen in FIGS. 5, 7, and 8. Additional section 12 is provided with shoulders 24 and tab 23 (optionally cut with a springing section 27) which interact with the cuts made in flap C'. When the reclosable opening 20 is closed, for example as shown in FIG. 7, the small edge openings 25 engage the shoulders 24 and the slot-like opening 22 engages the edge 21 of the tab 23 to provide positive locking in three places. It is important to note that this locking of the reclosable opening is virtually automatic as compared to an insertable tab flap which can also be provided by rounded portion 46 mentioned above.

The tab 23 uniquely provides a discernible tactile and audible "snap" action when reclosable opening 20 is closed and reopened. This snap action is caused or provided by the fact that the edge 21, in its relaxed condition, extends above the plane of the top surface of the box after the reclosable opening 20 is closed. Thus, the edge 21 is resiliently locked into the slot 22 of flap C'. As can be seen from the figures, the tab 23 bends inwardly as the reclosable opening 20 is closed, with the edge 21 snapping into the corresponding slot 22 only when the box is securely and adequately closed.

This bending action of tab 23 may be advantageously enhanced by optionally providing at least one horizontal score line 54 parallel to the tab edge 21, at a suitable position on the tab 23. A suitable position for this optional horizontal score line 54 for a cigarette box, by way of example only, would be nearer to tab edge 21 so that the tab 23 may flex over the relatively stiff cigarettes contained in the box.

The strength of the resilient action of tab 23 is determined by the width of the tab and its height, and the strength of the material of the blank, both in terms of its separation from the additional section 12 and how far above the plane of the top of the box the tab 23 extends when in its relaxed state. Another important aspect of the tab 23 is the undercut of edge 21 at the upper corners of the tab 23. This undercut may suitably be achieved in a variety of ways or shapes which will be readily apparent to those skilled in the art. The undercut serves to ensure that only the edge 21 of the tab 23 becomes lodged in the slot 22 of flap C; because the tab 23 is itself wider than the slot 22.

The angular cuts 29 at the top of flap C' shown in FIG. 1 are not necessary, but assist in the folding operations to assure that the flap C' does not interfere with the perforated section 28.

Because redundant locking structures are provided, it is possible to omit one of the particular locking structures yet retain most, if not all, of the advantages of the invention. For example, it may be desirable to omit the locking mechanism provided by the shoulders 24 and the small edge openings 25. The small size of the cut-out waste portions produced when the small edge openings 25 are stamped may present difficulties in the manufacturing process, and thus it may be desirable to eliminate the presence of waste particles of such small size. Furthermore, when the invention is applied to boxes made of light gauge stock, such as cigarette boxes, for example, the shoulders 24 and small edge opening 25 may not have sufficient rigidity to prove advantageous.

Additional section 12 can also be cut with a lower spring section 27 (preferably three orthogonal cut lines as shown in FIG. 1) which will interact with the optional rounded cut 26 made in fold 31 mentioned above. Operation of this spring is best seen in FIG. 8 where it functions to hold the reclosable opening 20 in an open position while dispensing contents from the box. Spring 27 also operates to hold the reclosable opening 20 in a closed position as seen in FIGS. 4 and 7, for example.

A perforated portion 28 can also be provided on additional section 12. This perforated portion should be placed so that it extends as shown in FIGS. 3 and 5. As can be seen in FIGS. 3 and 5, this portion 28 of section 12 can be removed by tearing the perforation and this will result in increasing the dimensions of the mouth 50 of the box. This feature is advantageously applied in boxes for pasta such as spaghetti or the like where the size of the mouth of the box can be a gauge of premeasured portions for dispensing. For example, the box can be dimensioned so that the mouth 50 with portion 28 in place dispenses a single serving of spaghetti and when portion 28 is removed by tearing the perforation, a double serving of such pasta is dispensed.

While it should be readily apparent to any person of ordinary skill in the art how the blank of FIG. 1 folds up, for the sake of completeness the following information is provided. The dotted lines separating the panels A,B,C,D and extended position E from one another are score lines on the side of the blank facing away from the reader, i.e., ultimately on the outside of the assembled box. The dotted lines separating the panels A,B,C,D from the bottom flaps A",B",C",D" and the top flaps A',B',C',D' are also score lines on the side of the blank facing away from the reader, as are the fold lines 13,14 of the additional section 12.

The horizontal dotted lines at approximately the midline of the additional section 12 (about even with the shoulders 24) are score lines on the side of the blank facing the reader. Once the additional section 12 is folded downwardly, these score lines are then positioned is substantial alignment with the tops of the side panels B, D. The hinge fold line 31 is similarly a score line on the side of the blank facing the reader, and remains permanently facing inside the assembled box so that the reclosable opening hingedly swings out and away from the assembled box.

The dotted line separating the perforated part 28 from the additional section 12 is preferably perforated through. All of the solid lines of FIG. 1 are out lines.

Figure 2:
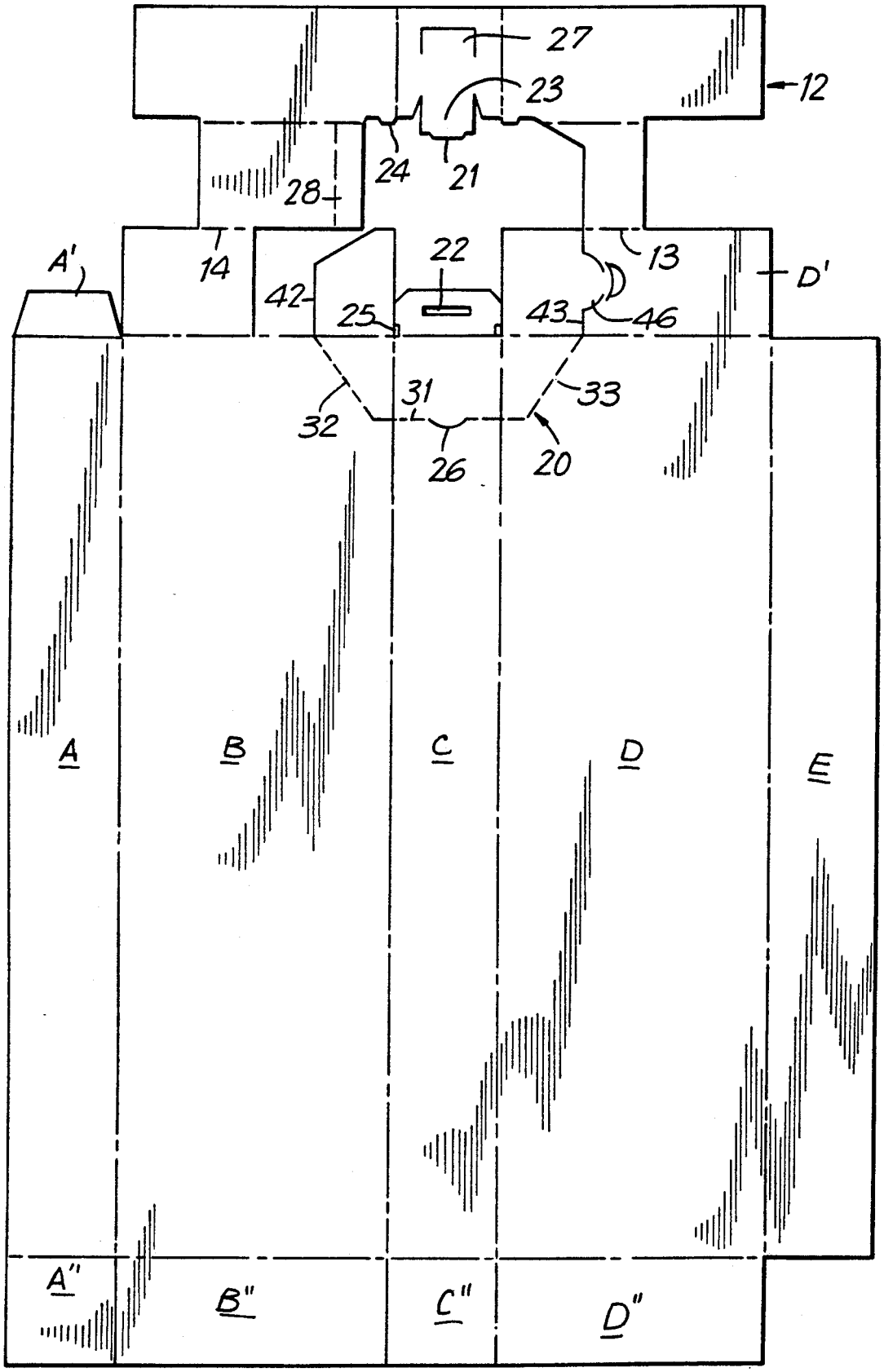
FIG. 2 is a view similar to FIG. 1 of an alternative embodiment of the invention where additional section 12 is in a slightly different position.
Figure 2A:
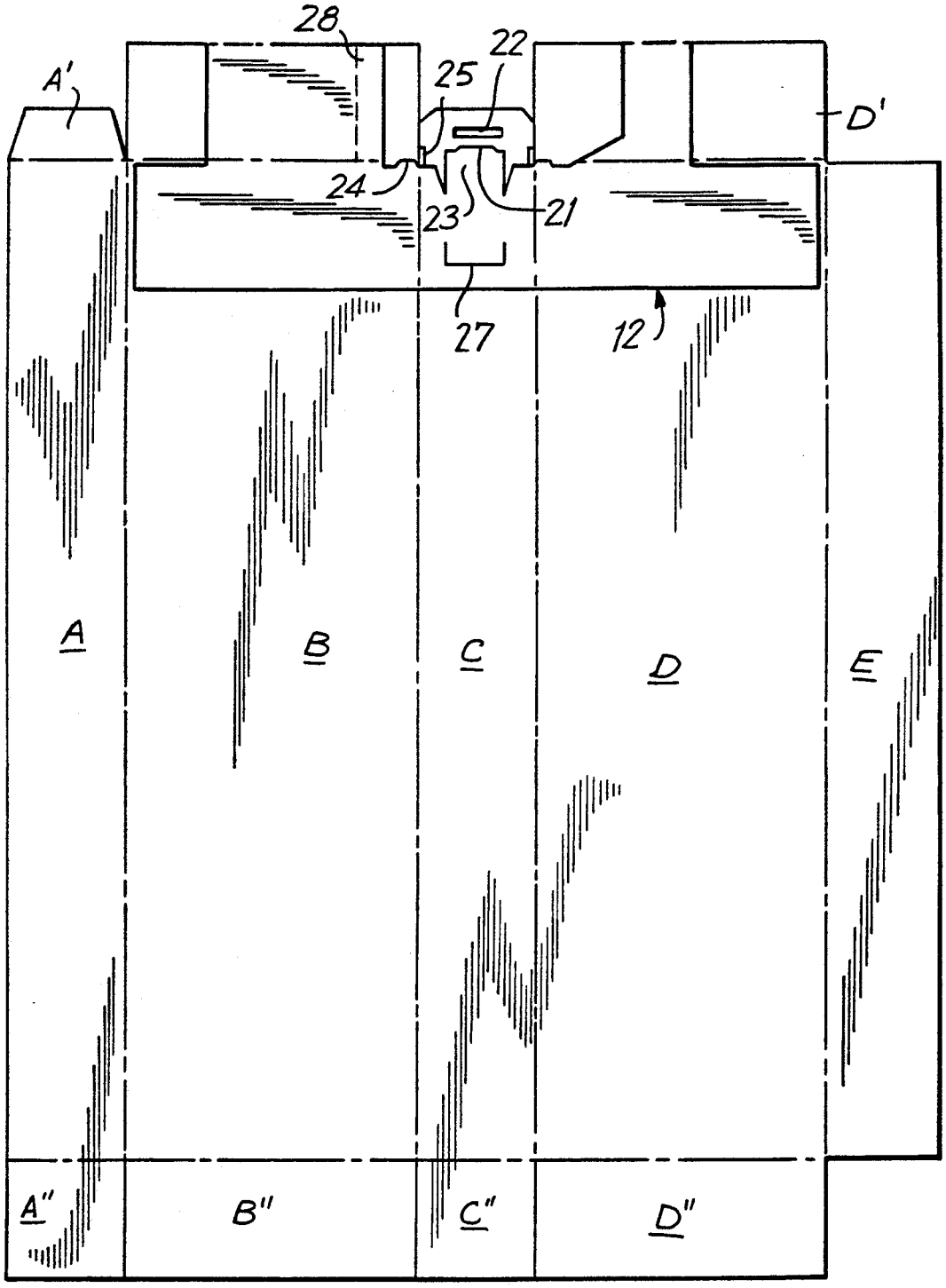
FIG. 2A is a view similar to FIG. 1A, but corresponding to the embodiment of FIG. 2.

FIG. 2 shows an alternative embodiment of the inventive blank 10 for creating the box according to this invention. The main difference between FIGS. 1 and 2 is the placement of the fold lines 13,14 separating the additional section 12 from the adjacent flaps B',D'. Moreover, FIG. 2 helps to illustrate how one could construct additional section 12 as a separate piece cut from a different blank. For example if the fold lines 13,14 in FIG. 2 were cut lines, it will be readily seen how section 12 could be made from a separate blank. FIG. 2A shows section 12 folded into position, but also illustrates how section 12 would be placed if it were cut from a separate blank. Additional section 12 would, if cut or stamped from a separate blank, preferably be attached by adhesive means at more than one location such as is employed in the embodiment of FIG. 1.

Figure 6:
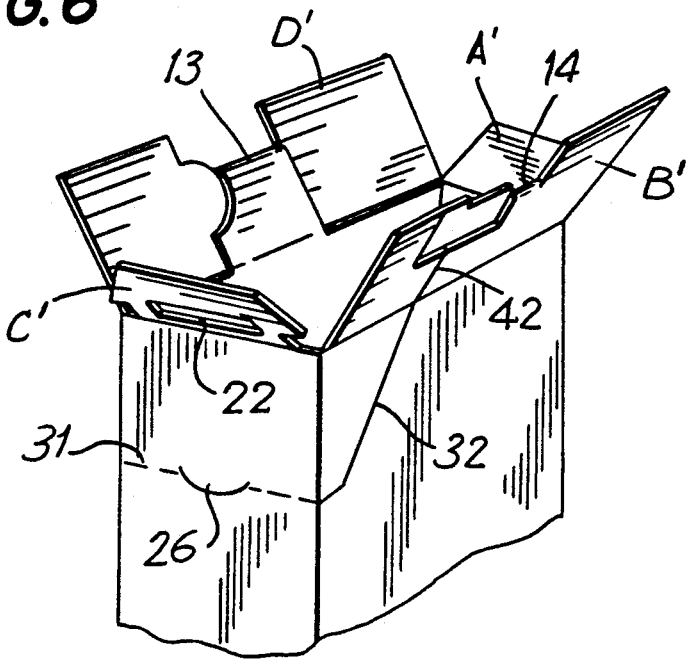
FIG. 6 is a perspective view of a box in a stage of partial construction according to FIG. 1.

FIG. 6 shows the blank of FIG. 1 folded into a partially constructed box. The flaps A',B',C',D' remain open so that the box can be filled with contents. The partially constructed box as shown in FIG. 6 is suitable for filling by automated filling apparatus and processes, as is customary. It should be noted that these flaps A',B',C',D' could be closed and the box could be filled from the other end by way of flaps A",B",C",D".

After the box is filled, two flaps A',C' are folded in and then the two remaining open flaps B',D' are folded in, the last flap to be folded being the one which contains the cut line with the rounded portion 46. The flaps are preferably glued or otherwise adhesively secured closed in a manner well known in the art.

When flap C' is folded over, it receives edge 21 of tab 23 in its slot-like opening 22 and its edge openings engage shoulders 24 until the box is opened by the user, as is apparent from FIGS. 5, 7, and 8.

After the box according to the preferred embodiment is constructed and filled, it appears to the consumer generally as depicted in FIG. 4. The lines 32,33 are preferably perforated lines so that the reclosable opening 20 will remain securely closed during shipping. As noted above, however, these lines could be cut lines rather than perforations provided the box is protected during shipping, e.g., by wrapping in plastic.

When the user first opens the box, the perforations in lines 32,33 are broken as shown generally in FIGS. 5 and 8. If line 26 is perforated rather than cut, the perforations of line 26 are also broken upon first opening.

Upon opening the box, mouth 50 is uncovered whereby the contents of the box may be poured out. If the contents are, for example, spaghetti type pasta, the size of the mouth 50 will determine the quantity of contents pouring forth from the mouth 50 when the box is tilted. As mentioned above, the mouth can be dimensioned to allow a measured single portion of contents to empty from the box at one time. The user then has the option of removing perforated portion 28 to allow dispensing of a larger, e.g., double, portion. Suitable instructions may be printed directly on the outwardly facing side of perforated portion 28 for ease and convenience of use.

In the open position, rounded portion 26 and spring 27 interact as shown in FIG. 8 to hold the reclosable portion 20 out of the way of contents emerging from the box through the open mouth 50.

After the box has been opened for the first time, it can be reclosed by moving the reclosable portion 20 back on its hinge 31. FIGS. 5, 7 and 8 show how up to four different locking means can be used to help keep the reclosable opening 20 in the closed position until intentionally reopened. First, rounded portion 26 and spring 27 interact. Second, shoulders 24 are received by openings 25. Third, slot 22 receives the edge 21 of tab 23. Fourth, the user can manually insert tab 46 under line 42. As will be readily seen, three of these four locking means are virtually automatic and do not require intentional action or manipulation on the part of the user, other than moving the reclosable portion 20 to its closed position.

It will also be apparent to those of ordinary skill upon inspection of FIGS. 5 and 8, for example, that the mouth 50 and the additional section 12 can be stamped or cut to form openings suited to a variety of different purposes. For example, the additional security provided by the shoulders 24 interacting with the small edge openings 25 may be deemed unnecessary in a cigarette package. Accordingly, the areas of the additional section 12 which form the sides of the assembled box may be partially eliminated, thus rendering access to the contents of the box easier, especially with ones fingers.

This would be important in a cigarette package of generally reduced dimensions.

Figure 9:
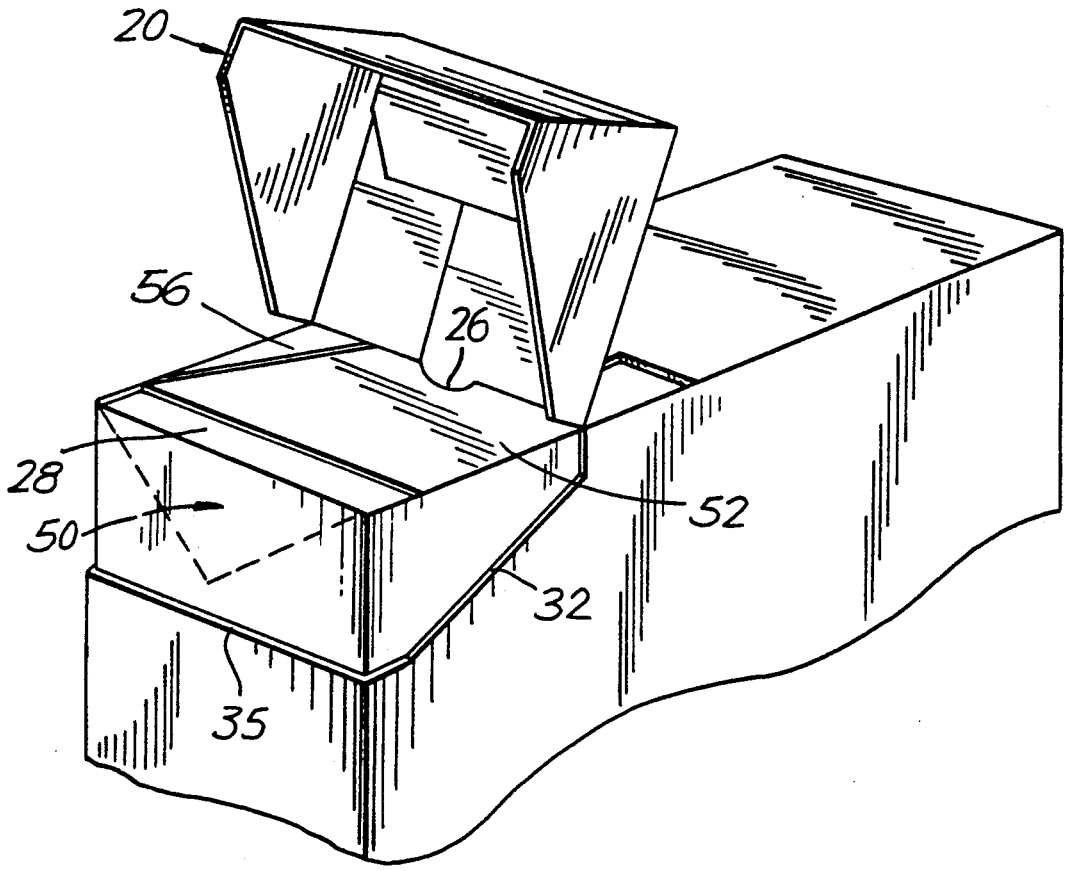
FIG. 9 is a view similar to FIG. 3 but of an alternate embodiment constructed according to FIG. 10.
Figure 10:
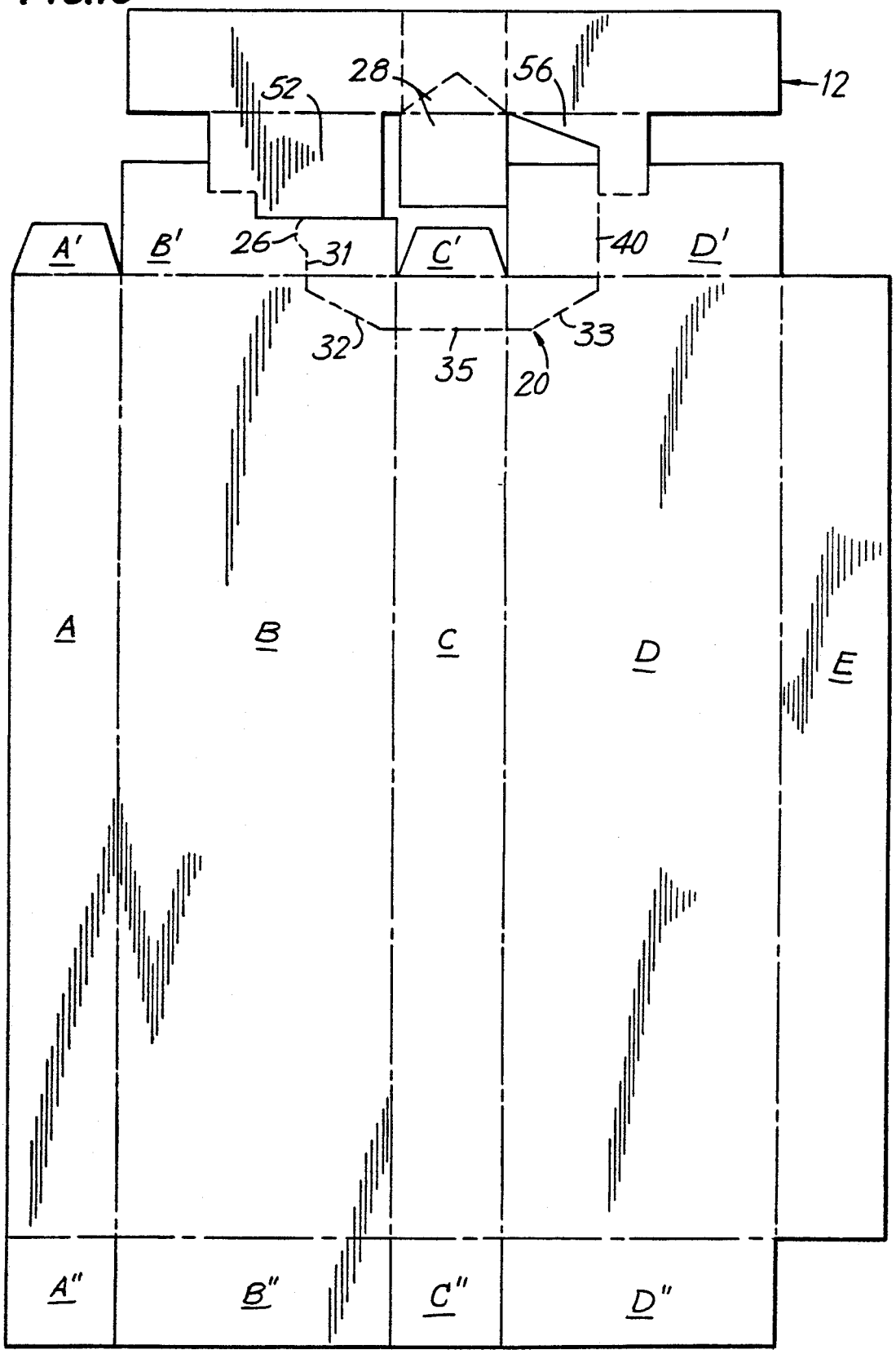
FIG. 10 is a view similar to FIG. 1 of an alternate embodiment of the invention.
Figure 10A:
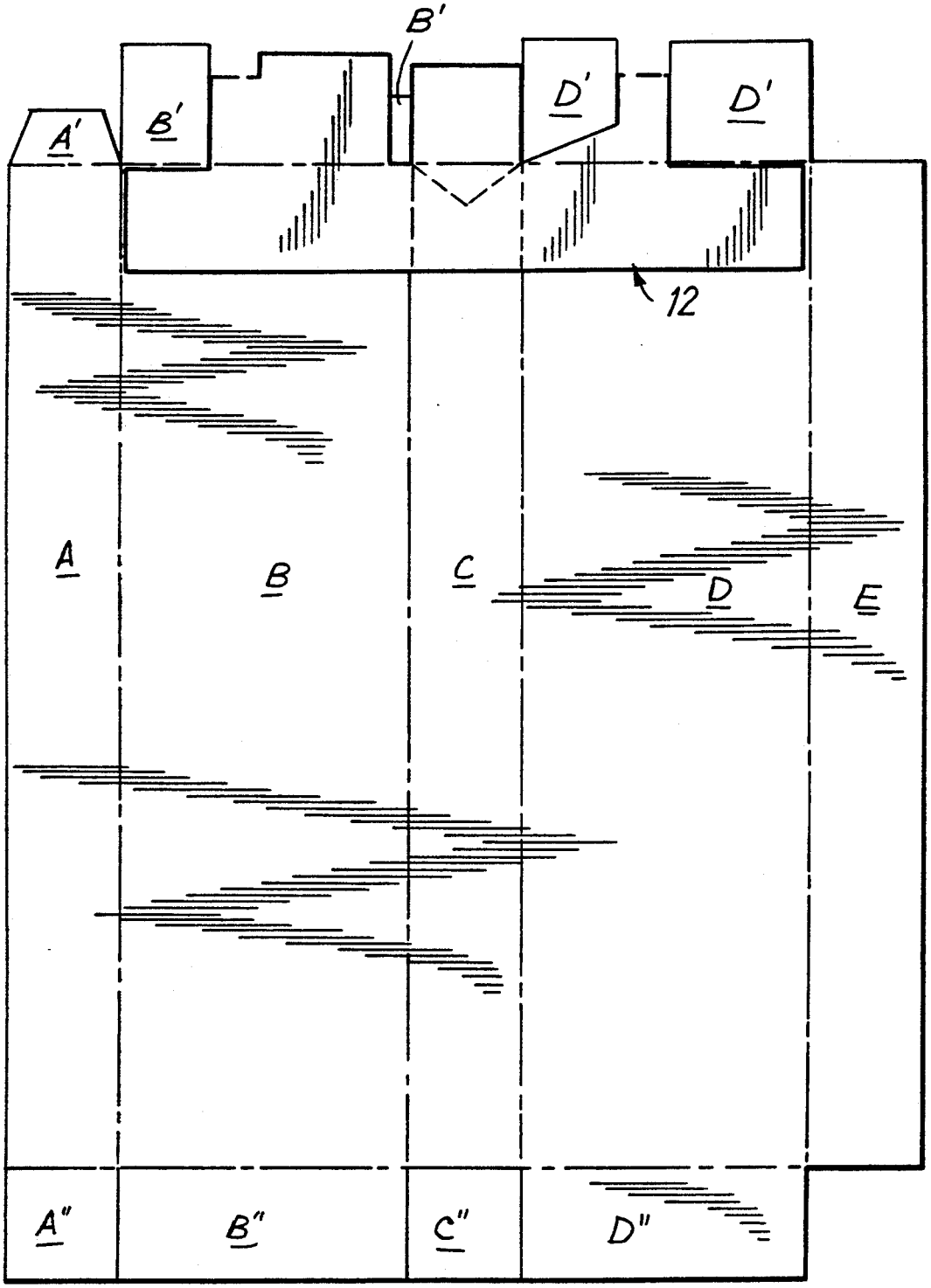
FIG. 10A is a view similar to FIG. 10 but with additional section 12 folded down.
Figure 11:
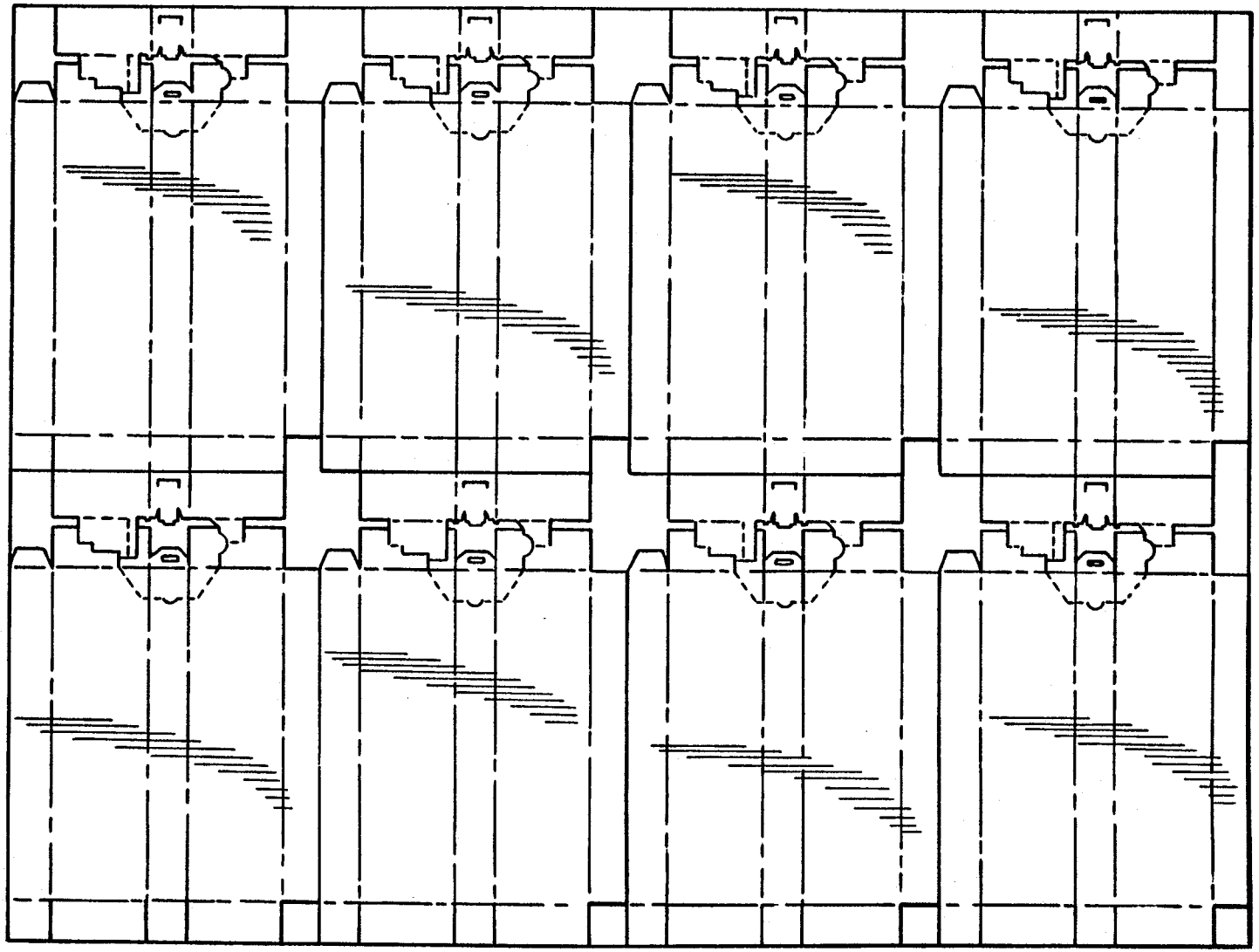
FIG. 11 is a view similar to FIG. 1 showing a plurality of flat blanks to be cut from a single sheet in mass production.

FIGS. 9, 10 and 10A show a third embodiment of the box and blank according to the invention. In this embodiment the hinged reclosable opening 20 is provided over a mouth of the box which extends along the top of the box and down around the box corner, partially on the side of the box. As will be seen, this configuration is especially useful for packaging "pourable" products such as detergents, because of the "side pour" opening.

In the embodiment of FIGS. 9, 10 and 10A, the reclosable opening 20 is formed with fold lines 31 on flap B, and 40 on flap D'. On panel C is a cut or perforated line 35 which adjoins cut or perforated lines 32,33, similar to the cut or perforated lines 32,33 shown in FIG. 1. Flat section 52 acts as a bias or spring member when the box is fully constructed. Perforated portion 28 is also reconfigured as best seen in FIG. 9. Here perforated portion 28 has a fold line which covers a corner of mouth 50. The box of FIG. 9 is assembled from the blank of FIGS. 10 and 10A by folding down and gluing additional section 12, then folding the side panels A,B,C,D and extended portion E and gluing side panel A to extended portion E, then folding inwardly the flaps A' and C', and finally folding and gluing flaps B' and D'. When so folded, overlapping section 56 serves to help keep fine-grained materials in the box.

As shown in FIG. 9, mouth 50 remains closed until perforated portion 28 is moved or removed. This additional closure or sealing portion 28 is advantageously used in the packaging of fine granular products such as detergents and the like. The extra protection provided by portion 28 assists in preventing spillage of product during shipping or while displayed on a retailer's shelves.

Two locking means are shown in FIGS. 9 and 10, namely the rounded portion 26 interacting with spring 52, plus the tension that is created when additional section 12 is glued down and folded. A snug friction fit is created under reclosable opening 20 which serves to hold opening 20 down and in its closed position.

As already noted, this last embodiment may be advantageously applied to package contents such as detergents where the double locking means shown is sufficient and where the removable configuration of perforated portion 28 is suitable for keeping the contents of the box from spilling out during shipping.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A reclosable box comprising:

four side panels, a bottom flap and a top flap; and a reclosable closure formed of portions of three of the side panels and the top flap;

the reclosable closure comprising an orthogonal hinge line on a first one of the side panels and a cut line on each of a second and third ones of the side panels adjacent to the first one of the side panels, the cut lines on the second and third side panels terminating at an edge adjacent to the hinge line, and a cut line on the top flap, the cut line on the top flap terminating at edges adjacent to the cut lines on the second and third side panels, the cut lines being chosen from the group consisting of perforated cut lines and continuous cut lines; and an additional section affixed to an inside portion of the first, second and third side panels;

the reclosable box having resilient biasing means for holding the reclosable closure in a open position until pulled to a closed position, the resilient biasing means comprising a tap portion formed in the hinge line and a spring portion cut in the additional section, the tab portion biasing the spring portion of the additional section when the reclosable closure is hingedly moved.

2. A reclosable box comprising:

four side panels, a bottom flap and a top flap; and a reclosable closure formed of portions of three of the side panels and the top flap;

the reclosable closure comprising an orthogonal hinge line on a first one of the side panels and a cut line on each of a second and third ones of the side panels adjacent to the first one of the side panels, the cut lines on the second and third side panels terminating at an edge adjacent to the hinge line, and a cut line on the top flap, the cut line on the top flap terminating at edges adjacent to the cut lines on the second and third side panels, the cut lines being chosen from the group consisting of perforated cut lines and continuous cut lines;

an additional section affixed to an inside portion of the first, second and third side panels; and locking means for holding the reclosable closure in a closed position until pulled to an open position, wherein the locking means comprises a resilient tab portion of the additional section and a tab receiving means on the reclosable closure whereby when the reclosable closure is closed, the tab receiving means biases and receives the resilient tab portion of the additional section thereby locking the reclosable closure in a closed position.

3. A reclosable box comprising:

four side panels, a bottom flap and a top flap; and a reclosable closure formed of portions of three of the side panels and the top flap;

the reclosable closure comprising an orthogonal hinge line on a first one of the side panels and a cut line on each of a second and third ones of the side panels adjacent to the first one of the side panels the cut lines on the second and third side panels terminating at an edge adjacent to the hinge line, and a cut line on the top flap, the cut line on the top flap terminating at edges adjacent to the cut lines on the second and third side panels, the cut lines being chosen from the group consisting of perforated cut lines and continuous cut lines;

an additional section affixed to an inside portion of the first, second and third side panels such that the additional section defines a mouth of the box when the reclosable closure is opened, the mouth having a first predetermined size; and locking means for holding the reclosable closure in a closed position until pulled to an open position.

4. A reclosable box as claimed in claim 3, wherein the additional section includes at least one removable section for enlarging the mouth to have a second predetermined size.

5. A reclosable box comprising:

four side panels, a bottom flap and a top flap; and a reclosable closure formed of portions of three of the side panels and the top flap;

the reclosable closure comprising an orthogonal hinge line on a first one of the side panels and a cut line on each of a second and third ones of the side panels adjacent to the first one of the side panels, the cut lines on the second and third side panels terminating at an edge adjacent to the hinge line, and a cut line on the top flap, the cut line on the top flap terminating at edges adjacent to the cut lines on the second and third side panels, the cut lines being chosen from the group consisting of perforated cut lines and continuous cut lines; and an additional section affixed to an inside portion of the first, second and third side panels, wherein the additional section comprises shoulder means and the reclosable closure includes recess means such that when the reclosable closure is closed, the shoulder means are received by the recess means to provide a first locking means for holding the reclosable closure in a closed position until pulled to an open position, and wherein the additional section and the reclosable closure engage when the box is closed to provide a second locking means for holding the reclosable closure in a closed position until pulled to an open position.

6. A reclosable box comprising four sides and two ends;

a reclosable closure formed on three of the sides and one of the ends by a fold line and three cut lines;

an additional section affixed to an inside surface of the side having the fold line;

the additional section defining locking means whereby an inside surface of the reclosable closure interacts with the additional section to lock the reclosable closure in a closed position.

7. The reclosable box of claim 6 wherein the additional section is also provided with shoulder means and the inside surface of the reclosable closure is provided with recess means whereby when the reclosable closure is moved into a closed position, the recess means engage the shoulder means.

8. The reclosable box of claim 6 wherein the fold line is provided with a central rounded cut which biases the additional section when the reclosable closure is moved to an open position.

9. The reclosable box of claim 6 wherein the locking means comprises upstanding tab means on the additional section and the inside surface of the reclosable closure is provided with slot recess means whereby when the reclosable closure is moved into a closed position, the slot recess means biases and engages the upstanding tab means.

10. A blank erectable into a reclosable box, the blank comprising:

a substantially rectangular sheet having five defining fold lines, including three parallel spaced apart panel fold lines defining four side panels, three of said panels being a left side panel, a center side panel and a right side panel, and two spaced apart flap fold lines perpendicular to the panel fold lines defining two sets of end flaps, one of the sets including a left flap and a right flap;

a reclosable closure formed of adjacent portions of the left flap, the left side panel, the center side panel, the right side panel and the right flap;

the reclosable closure defined by five connecting lines, one line being on each of the left flap, left side panel, center side panel, right side panel and right flap, on lines on the left and right side panels extending substantially diagonally from a point at the panel fold line spaced in from the flap fold line to a point at the flap fold line spaced in from the panel fold line, the diagonal line being chosen from the group consisting of cut lines and perforated lines, the line on the center side panel being a hinge fold line parallel to and spaced apart from one of the panel fold lines defining one of the sets of flaps, and the two remaining lines being chosen from the group consisting of perforated lines and cut lines and being placed on the left and right flaps to separate the left and right flaps from the reclosable closure;

an additional section extending from the left and right flaps and separated therefrom by an additional section fold line, the additional section fold line being approximately centrally located on the left and right flaps; and the additional section being foldable along the additional section fold line to overlie a portion of the left and right flaps and a portion of the left, right and center side panels;

whereby the additional section is provided with locking means to interact with the reclosable closure when the blank is erected into a box.

11. A blank as claimed in claim 10 wherein the locking means of the reclosable closure comprises a center flap provided with locking means for interacting with the additional section when the blank is erected into a box.

12. A blank as claimed in claim 10 wherein the hinge line is provided with a central rounded cut and the additional section is provided with a substantially U-shaped cut which overlies the rounded cut when the additional section is folded on the additional section fold line.

13. A blank as claimed in claim 11 wherein the center flap is provided with an opening and the additional section is provided with an extension which engages the opening when the blank is erected into a box.

14. A blank as claimed in claim 11 wherein the center flap is provided with a notch near the intersection of two of the defining lines and the additional section is provided with a second extension which engages the notch when the blank is erected into a box.

15. A blank as claimed in claim 10 wherein the additional section is provided with a perforated part, the perforated part overlying a mouth of the box when the blank is erected into a box whereby the perforated part can be removed to enlarge the mouth of the box.

16. A reclosable box comprising:

four side panels, a bottom flap and a top flap;

a reclosable closure formed of portions of three of the side panels and the top flap, the reclosable closure comprising:

an orthogonal hinge line on the top panel;

a cut line on a first one of the side panels, and a cut line on each of a second and third ones of the side panels adjacent to the first one of the side panels, the cut lines on the second and third side panels extending from a first and second edge adjacent to the hinge line on the top panel to a first and second end, respectively, of the cut line on the first one of the side panels, the cut lines being chosen from the group consisting of perforated cut lines and continuous cut lines;

an additional section affixed to an inside portion of the first, second and third side panels; and resilient biasing means for holding the reclosable closure in an open position until pulled to a closed position, wherein the resilient biasing means comprises a tab portion formed in the hinge line and a spring portion of the additional section, the tab portion biasing the spring portion of the additional section when the reclosable closure is hingedly moved.

17. A reclosable box comprising:

four side panels, a bottom flap and a top flap; and a reclosable closure formed of portions of three of the side panels and the top flap;

the reclosable closure comprising an orthogonal hinge line on the top panel, a cut line on a first one of the side panels, and a cut line on each of a second and third ones of the side panels adjacent to the first one of the side panels, the cut lines on the second and third side panels extending from a first and second edge adjacent to the hinge line on the top panel to a first and second end, respectively, of the cut line on the first one of the side panels;

the cut lines being chosen from the group consisting of perforated cut lines and continuous cut lines;

locking means for holding the reclosable closure in a closed position until pulled to an open position;

an additional section affixed to an inside portion of the first, second and third side panels, wherein the additional section is affixed to the inside portion of the first, second and third side panels such that the additional section defines a mouth of the box when the reclosable closure is opened, the mouth having a first predetermined size, and wherein the additional section includes at least one removable section for enlarging the mouth to have a second predetermined size.

18. A reclosable box comprising:

four side panels, a bottom flap and a top flap; and a reclosable closure formed of portions of three of the side panels and the top flap;

the reclosable closure comprising an orthogonal hinge line on the top panel, a cut line on a first one of the side panels, and a cut line on each of a second and third ones of the side panels adjacent to the first one of the side panels, the cut lines on the second and third side panels extending from a first and second edge adjacent to the hinge line on the top panel to a first and second end, respectively, of the cut line on the first one of the side panels;

the cut lines being chosen from the group consisting of perforated cut lines and continuous cut lines;

locking means for holding the reclosable closure in a closed position until pulled to an open position;

an additional section affixed to an inside portion of the first, second and third side panels, wherein the additional section is affixed to the inside portion of the first, second and third side panels such that the additional section defines a mouth of the box when the reclosable closure is opened, the mouth having a first predetermined size, and wherein the additional section includes at least one removable section which, before its removal, substantially covers the mouth of the box.

19. A blank erectable into a reclosable box, the blank comprising:

a substantially rectangular sheet having five defining fold lines, the five defining fold lines being three parallel spaced apart panel fold lines defining four side panels, three of the four side panels being a left side panel, a center side panel and a right side panel, and two spaced apart flap fold lines perpendicular to the panel fold lines defining two sets of end flaps, one of the sets being a left flap and a right flap;

a reclosable closure formed on five adjacent portions of the left flap, the left side panel, the center side panel, the right side panel and the right flap, and being defined by five connecting lines, one line being on each of the aforesaid left flap, right flap, and left, center and right side panels, wherein the defining lines on the left and right side panels extend substantially diagonally from a point at the panel fold line spaced in from the flap fold line to a point at the flap fold line spaced in from the panel fold line, the substantially diagonal defining lines being chosen from the group consisting of cut lines and perforated lines, and wherein the defining lines on the left and right flaps are hinge fold lines, the hinge fold lines being parallel to and spaced apart from the panel fold lines defining the center side panel, and wherein the fifth defining line is an orthogonal line chosen from the group consisting of perforated lines and cut lines and is located on the center side panel extending from the substantially diagonal line on the left side panel to the substantially diagonal line on the right side panel; and an additional section extending from the left and right flaps and separated therefrom by an additional section fold line;

the additional section being foldable along the additional section fold line to overlie a portion of the left and right flaps and a portion of the left, right and center side panels;

whereby the additional section is provided with spring means to interact with the reclosable closure when the blank is erected into a box.

20. A blank as claimed in claim 19 wherein the hinge line is provided with a central rounded cut which overlies the spring means of the additional section is folded on the additional section fold line.

* * * * *